US005565811A

United States Patent [19]

Park et al.

[11] Patent Number: 5,565,811

[45] Date of Patent: Oct. 15, 1996

[54] REFERENCE VOLTAGE GENERATING CIRCUIT HAVING A POWER CONSERVING START-UP CIRCUIT

[75] Inventors: Jong-Hoon Park, Kyungki-do; Young-Keun Choi, Kyunggi-do, both of Rep. of Korea

[73] Assignee: L G Semicon Co., Ltd., Cheongju, Rep. of Korea

[21] Appl. No.: 388,074

[22] Filed: Feb. 14, 1995

[30] Foreign Application Priority Data

Feb. 15, 1994 [KR] Rep. of Korea ..... 94-2611

[51] Int. Cl.[6] ..... G05F 3/02

[52] U.S. Cl. ..... 327/546; 327/143; 327/198; 327/541

[58] Field of Search ..... 327/142, 143, 327/537, 180, 50, 309, 321, 318, 331, 328, 535, 198, 538, 540, 541, 543, 544, 545, 546

[56] References Cited

U.S. PATENT DOCUMENTS

| | | | |
|---|---|---|---|
| 4,495,425 | 1/1985 | McKenzie | 327/511 |
| 4,717,840 | 1/1988 | Ouyang et al. | 327/143 |
| 4,983,857 | 1/1991 | Steele | 327/143 |
| 5,077,518 | 12/1991 | Han | 327/537 |
| 5,083,079 | 1/1992 | Plants | 327/537 |
| 5,109,187 | 4/1992 | Guliani | 327/537 |
| 5,155,384 | 10/1992 | Ruetz | 327/537 |
| 5,243,231 | 9/1993 | Baik | 307/296.3 |
| 5,243,233 | 8/1993 | Cliff | 307/296.4 |
| 5,321,317 | 6/1994 | Pascucci et al. | 327/546 |
| 5,323,067 | 6/1994 | Shay | 327/142 |

FOREIGN PATENT DOCUMENTS

| | | | |
|---|---|---|---|
| 5-14158 | 1/1993 | Japan | 327/198 |
| 5-175812 | 7/1993 | Japan . | |

OTHER PUBLICATIONS

Hoi–Jun Yoo, et al.; "A Precision CMOS Voltage Reference with Enhanced Stability for the Application to Advanced VLSI's"; 1993 IEEE; pp. 1318–1321.

Official Gazette Notice of USP No. 5,243,233.

*Primary Examiner*—Timothy P. Callahan
*Assistant Examiner*—Terry L. Englund
*Attorney, Agent, or Firm*—Alan R. Loudermilk

[57] ABSTRACT

A power conserving circuit is disclosed which has a start-up circuit for initiating operation of a reference voltage generator. Included are a sensing circuit for producing a pulse signal in response to initial application of an external power source; a reference voltage generator for producing a constant reference voltage independent from an external power source voltage; and a start-up circuit for starting operation of the reference voltage generator during an interval of a pulse produced by the sensing circuit. The start-up circuit includes a switch for connecting and disconnecting the external power source to the reference voltage output port, and a voltage reducing element connected between the switch and the reference voltage output port.

8 Claims, 4 Drawing Sheets

REFERENCE VOLTAGE GENERATING CIRCUIT HAVING A POWER CONSERVING START-UP CIRCUIT

BACKGROUND OF THE INVENTION

The present invention relates to reference voltage generating circuits in semiconductor devices, and more particularly to a reference voltage generating circuit in which a reference voltage is produced by converting a voltage level from an external power source and in which a start-up circuit initiates operation of a reference voltage generator when external power is applied.

Recent CMOS semiconductor devices have been manufactured with ultra high density in accordance with submicron design rules.

While the size of semiconductor devices is being reduced according to manufacturing technology developments, 5 volts of DC power still is used most commonly for operation of the semiconductor devices. The 5 volts of power sometimes causes hot carrier problems in high density devices, resulting in lower reliability. In order to solve the hot carrier problems, the voltage level of the external power source needs to be reduced to a lower level in order to generate the internal power used to operate the devices. With this solution, reduction of power consumption also will be achieved.

FIG. 1 illustrates a circuit for generating an internal reference voltage. As illustrated in FIG. 1, circuit 1 includes two PMOS transistors, MP0 and MP1, two NMOS transistors, MN0 and MN1, and resistor R1. This circuit has two operating states. One state is that of normal operation in which a reference voltage is generated, and the other state is one in which a reference voltage is not generated, because the current between the source and drain of the NMOS and PMOS transistors is nearly zero amperes.

Particularly during the initial stage of power application from the power supply, since the MOS transistors start their operation with zero current and voltage, sometimes the transistors do not arrive at a normal operation state without means to assist their operation. Thus, this circuit does not start up independently.

In order to solve this problem of non-self-start-up, the circuit for generating a reference voltage has to include a start-up circuit so that all MOS transistors reach a normal operation state, such as are illustrated in FIG. 2 and FIG. 3.

An improved circuit for generating a reference voltage illustrated in FIG. 2 comprises reference voltage generator 1, which includes MOS transistors MP0, MP1, MN0 and MN1 and resistor R1, and start-up circuit 2, which includes a number of PMOS transistors $MPS_0$-$MPS_{m-1}$, and also transistor MPSm. In the start-up circuit, PMOS transistors $MPS_0$-$MPS_{m-1}$ are connected in series between Vcc and Vss, and the gates are connected to a source of an adjacent PMOS transistor like a diode as illustrated. The source of MOS transistor MPSm is connected to the gate of PMOS transistor MP0, the gate of transistor MPSm to the gate of transistor MPS1, and the drain of transistor MPSm to Vss.

In FIG. 2, the voltage level of the source of transistor MPSm is equal to Vcc-Vth because it is connected to the gate of transistor MP0. The gate voltage of MOS transistor MPSm in start-up circuit 2, which is connected to the gate of PMOS transistor MPS1, is equal to Vcc-2Vth.

Here, in order to make the same Vth of in-series-connected PMOS transistors MPSo-MPSm−1 between power source Vcc and ground Vss, the bulk of the PMOS transistors are connected to their respective sources. The source voltage of PMOS transistor MPSm becomes Vcc-Vth, and the gate voltage of transistor MPSm becomes Vcc-2Vth. Accordingly, the voltage difference between the gate and the source of transistor MPSm maintains Vth, so that a certain amount of current flows from transistor MP0 to transistor MPSm, so that transistors MP0, MP1, MN0 and MN1 are turned-on in sequence. Thus, the circuit for generating a reference voltage operates in normal operation with transistors MP0 and MP1 turned-on.

As can be seen in FIG. 2, however, a plurality of transistors are connected in series between Vcc and Vss, and thus current flows through them, resulting in power consumption during normal operation, which is not desirable for low power operation.

In order to avoid such power consumption, a reference voltage generating circuit has been provided as illustrated in FIG. 3. This circuit was disclosed in U.S. Pat. No. 5,243,231. This circuit comprises reference voltage generator 1, and start-up circuit 3 consisting of resistor R2 and capacitor Co connected in series between power source Vcc and reference voltage terminal Vref. Reference voltage generator 1 generates a reference voltage and start-up circuit 3 generates a start-up current when the external voltage is applied to the Vcc and Vss nodes. In the circuit of FIG. 3, the structure of reference voltage generator 1 is similar to that of FIG. 1. In start-up circuit 3, resistor R2 and capacitor Co are connected in series between power source Vcc and reference voltage output Vref. If the Vcc voltage is increased, the voltage of node N1 and node Vref also are increased by a coupling effect with the Vcc node. If the reference voltage exceeds the threshold voltage of NMOS transistor MN1, transistor MN1 is turned on and transistor MP1 is turned on by the current drawn by transistor MN1 ($I_2$). The turning on of transistor MP1 causes current ($I_1$) to flow through transistor MPO, which in turn turns on transistor MN0. The current is controlled by resistor R1. That is, turned-on transistors MN1 and MP1 cause transistors MP0 and MN0 to start-up, so that the reference voltage generator operates normally. The reference voltage generator produces a reference voltage with a constant level, when the voltage level of Vcc is no longer increasing, with bias current $I_i$ held at a desired level and mirror current $I_2$ maintaining the same current as $I_1$, a constant reference voltage is output regardless of the Vcc level. If the reference voltage reaches a certain level, the coupling effect of capacitor Co is negligible, and thus the reference voltage generator operates normally.

This circuit has a disadvantage in that R-C coupling with Vcc may cause variation of the reference voltage when Vcc is very noisy. The reference voltage of this circuit may fluctuate when the Vcc level is changed during a voltage bump period or by external noise.

SUMMARY OF THE INVENTION

An object of this invention is to provide a reference voltage generating circuit having a start-up circuit, in which a reference voltage is generated with a constant level independent from an external power source.

According to the present invention a reference voltage generating circuit having a start-up circuit is provided which includes a sensing circuit for producing a pulse signal SU in response to initial application of an external power source, a reference voltage generator for producing a constant reference voltage independent to the external power source voltage; a start-up circuit for starting operation of the reference voltage generator during an interval of the pulse produced by the sensing circuit.

The start-up circuit comprises a switching means for connecting the external power source to the reference voltage output port, and disconnecting the external power source from the reference voltage output port, and a voltage reducing means connected between the switching means and the reference voltage output port.

Another embodiment of the start-up circuit may comprise a plurality of transistors connected in series in diode form, the end of the transistor train being connected to ground, and a switching transistor for connecting the other end of the transistor train to the gates of a pair of MOS transistors of a mirror circuit of the reference voltage generator, with its gate connected for receiving start-up signal SU produced by the sensing circuit.

The sensing circuit comprises a resistor means and a capacitor means connected in series between the external power source and ground, and inverter means with its input connected to a point between the resistor and the capacitor means.

The reference voltage generator for producing a constant reference voltage comprises two PMOS transistors, MP0 and MP1, with gates connected together and to the drain of transistor MP0, and sources connected to power source Vcc, two NMOS transistors, MN0 and MN1, with gates connected together and to the drain of transistor MP1, and resistor R1 connected between Vss and the source of transistor MN0, with the drains of MP1 and MN1 connected together and providing the output Vref, and with the drains of transistor MP0 and MN0 commonly connected to a switching transistor of the start-up circuit.

BRIEF DESCRIPTION OF THE DRAWINGS

The above objects and other advantages of the present invention will become more apparent by describing in detail the preferred embodiments of the present invention with reference to the attached drawings in which.

DESCRIPTION OF THE PREFERRED EMBODIMENTS

Figure 1:
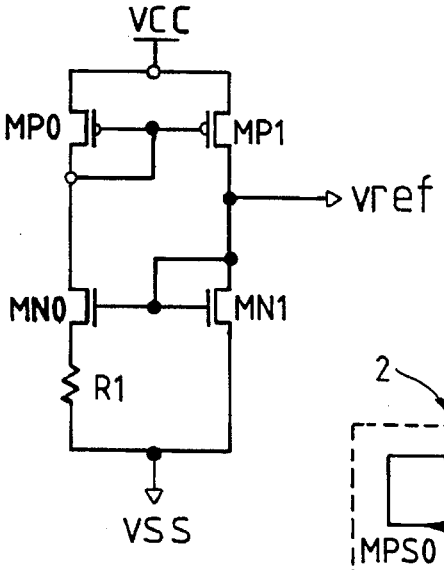
FIG. 1 PRIOR ART
FIG. 1, FIG. 2 and FIG. 3 are circuit diagrams illustrating conventional reference voltage generators.
Figure 2:
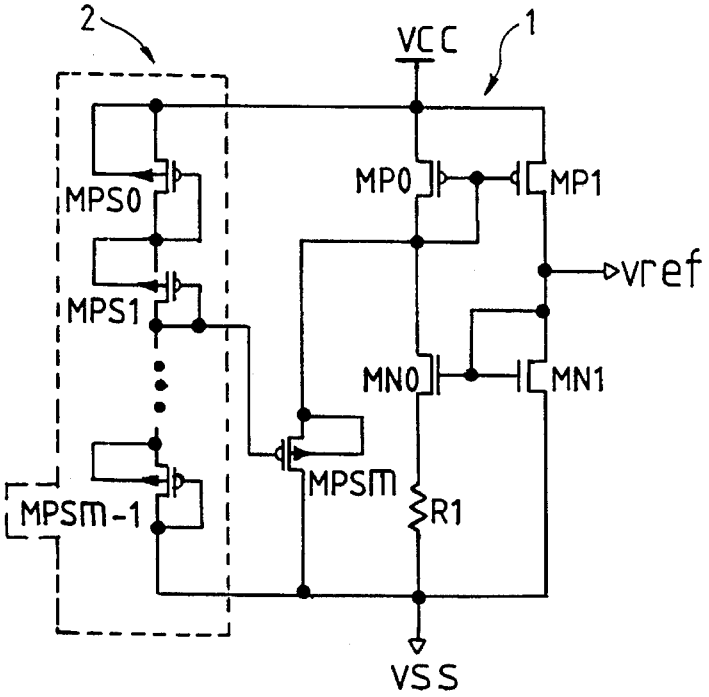
FIG. 2 PRIOR ART
Figure 3:
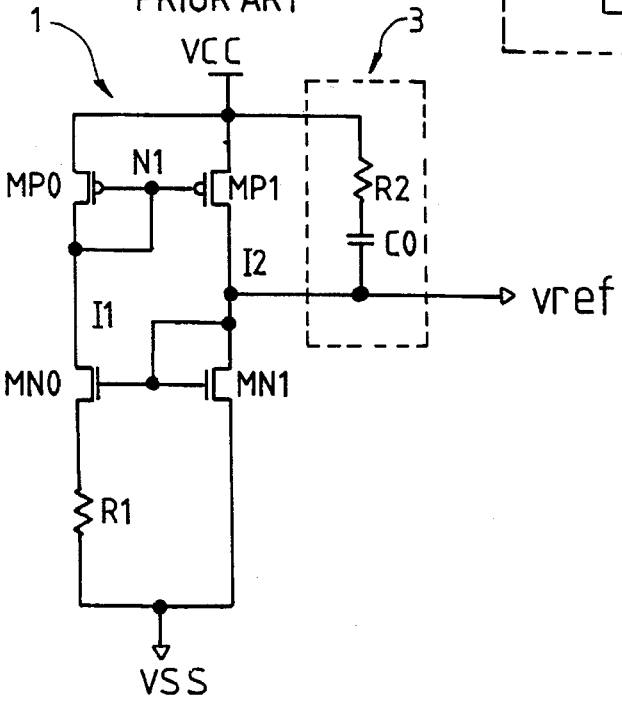
FIG. 3. PRIOR ART
Figure 4:
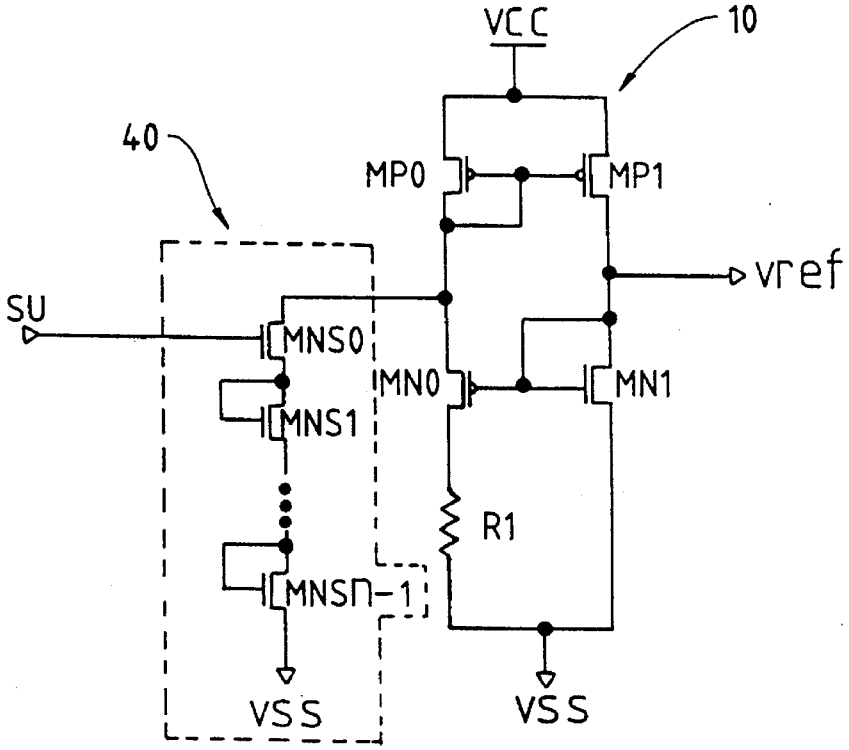
FIG. 4 illustrates a reference voltage generating circuit as a first embodiment according to present invention.

As illustrated in FIG. 4, a reference voltage generating circuit having a start-up circuit according to a first embodiment of the present invention includes reference voltage generator 10 and start-up circuit 40. With respect to reference voltage generator 10, a conventional circuit is used such as is disclosed in U.S. Pat. No. 5,243,231.

Start-up circuit 40 includes NMOS transistor MNSo, with its drain connected to the gate of transistor MP0 in reference voltage generator part 1, and with its gate receiving start-up signal SU. A plurality of NMOS transistors MNS1-MNSn−1 are connected in series in a diode configuration between the source of NMOS transistor MNSo and ground, or Vss.

Figure 5:
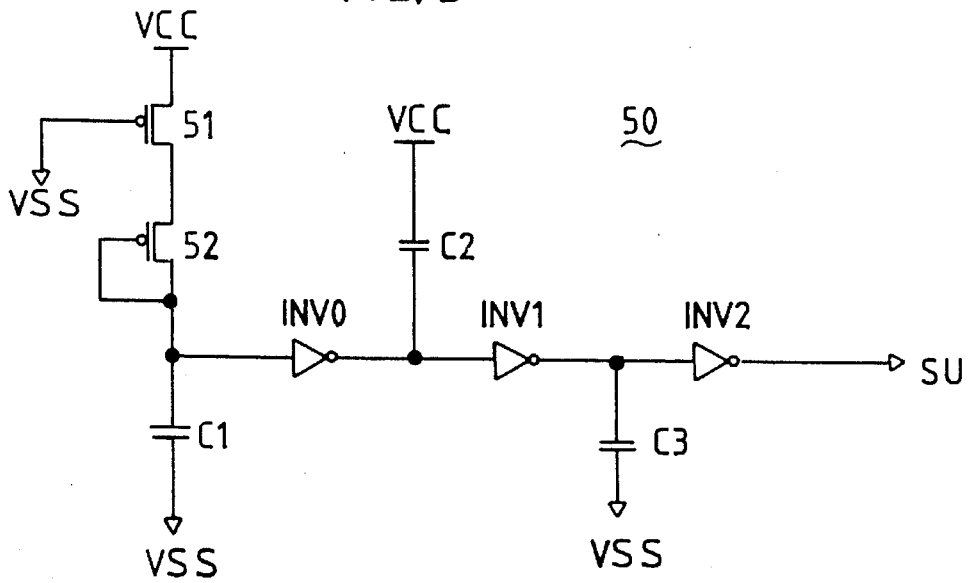
FIG. 5 is circuit diagram of a sensing circuit for sensing the power supply and generating a start-up signal as an output.

Start-up circuit 40 operates upon receiving start-up signal SU from a sensing circuit for detecting power supply assertion, and is illustrated in FIG. 5. Generally, sensing circuit 50 provides power supply detecting signals to several circuits for initialization purposes in a semiconductor device.

In sensing circuit 50 for detecting a power supply voltage, PMOS transistors 51 and 52 serve as resistance means connecting power source Vcc and capacitor means C1. PMOS transistors 51 and 52 and capacitor means C1 operate to transmit power input sensing signals SU to each circuit, whereby an increasing Vcc level causes start-up signal SU to be output as an increasing voltage level from inverter means INV2. When the voltage level of Vcc reaches a predetermined value, which is determined by the sizes of PMOS transistors 51 and 52, the capacitance value of C1, and the logic threshold voltage of inverter means INV0, the output of inverter means INV2 switches to what is known as a logic low level, and, start-up signal SU then drops toward zero (see FIG. 6). This switching of the output of inverter INV2 is initiated by the signal that is input to inverter INV0 reaching the logic threshold level of inverter INV0. Therefore, start-up signal SU maintains a high level until Vcc reaches a certain level; that is, an increasing voltage level is produced until the voltage at the input of inverter INV0 reaches the logic threshold voltage level of inverter INV0, and after switching by inverters INV0, INV1 and INV2, start-up signal SU then decreases towards zero.

Inverter INV0 outputs start-up signal SU through second inverter INV1 and third inverter INV2.

Sensing circuit 50 may be used as a peripheral circuit in semiconductor memory devices, especially in DRAM devices, wherein sensing circuit 50 for detecting power supply assertion senses an external power supply input voltage and produces start-up signal SU, so that a substrate voltage VBB of the DRAM is fixed to ground voltage during the time start-up signal SU is at a high level, to prevent the substrate voltage from increasing, and the substrate voltage generator (back bias voltage generator) starts its operation when start-up signal SU becomes a low level.

Figure 6:
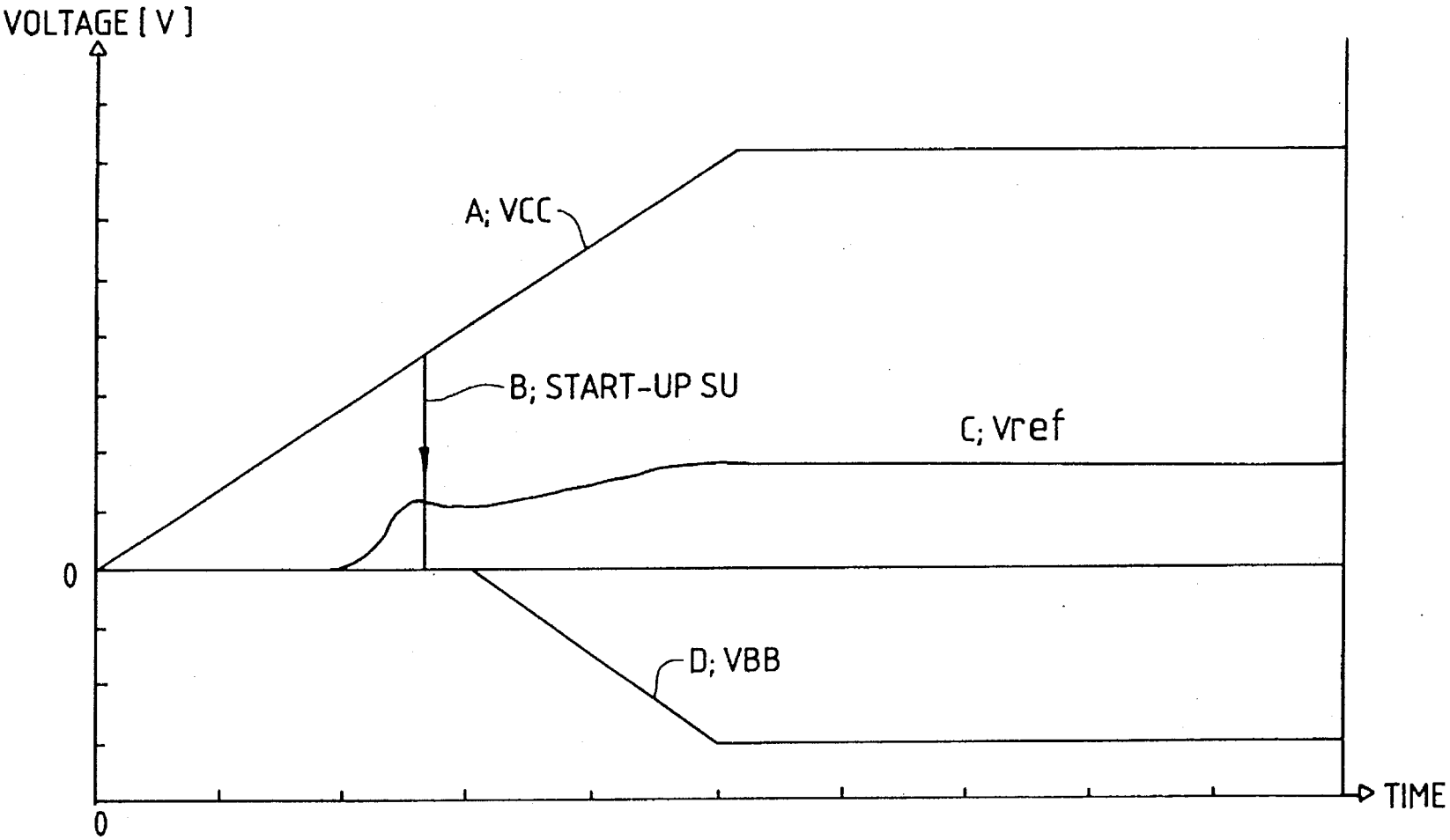
FIG. 6 illustrates the voltage level of various signals with respect to the operation of the circuit illustrated in FIG. 4.

A waveform of start-up signal SU is illustrated as graph B of FIG. 6. That is, the amplitude of the signal increases upon application of the Vcc power voltage, but becomes ground level at a predetermined power level. Such a start-up signal SU is input to start-up circuit 40.

As illustrated in FIG. 6, sensing circuit 50 produces start-up signal SU, which voltage level increases in accordance with the increasing of the Vcc voltage level to the predetermined level.

Such start-up signal SU is applied to the gate electrode of transistor MNSo of start-up circuit 40, which comprises a plurality of NMOS transistors. During the time the level of signal SU is high, its level becomes almost the same voltage level as Vcc. The high level interval of start-up signal SU is determined by the size of PMOS transistors 51 and 52 in sensing circuit 50, and the capacitance of capacitors C1, C2 and C3, and the threshold voltage of inverters INV0, INV1 and INV2.

The number of NMOS transistors connected in series are determined by the voltage level of start-up signal SU when signal SU changes its state. The turned-on NMOS transistors draw current to turn on PMOS transistors MP0 and MP1 of reference voltage generator 10.

Reference voltage generator 10 starts its operation when PMOS transistors MP0 and MP1 are turned on by the start-up circuit.

FIG. 6 illustrates a waveform using a start-up circuit designed using 3 transistors. In FIG. 6 it is assumed that every NMOS transistor is formed on a P-type substrate and the P-type substrate is biased with a substrate bias voltage (VBB). In FIG. 6, waveform A denotes the voltage level of Vcc, waveform B denotes start-up signal SU, waveform C denotes reference voltage Vref, and waveform D denotes substrate bias voltage VBB.

When start-up signal SU increases along with the Vcc level, the reference voltage generator starts to produce the Vref voltage, as the start-up circuit activates the reference voltage generator by setting start-up signal SU high. The voltage level of Vref while SU signal is high is determined by the current flows in the start-up circuit.

Generally, and especially in a DRAM in which a VBB generator is used to bias the P-type substrate, the Vbb level is clamped to Vss during an initial period of application of the external Vcc supply. After start-up signal SU changes its state from "high" to "low," the VBB generator starts to pump for the substrate to obtain the appropriate substrate bias voltage. Therefore, Vref, which is made from the threshold voltage of a NMOS transistor, is held at a level lower than the target value as VBB is not sufficiently low. As VBB obtains its final target value, Vref reaches its own target voltage, as well. When VBB is stabilized, so is Vref.

If signal SU becomes a high level, current flowing through start-up circuit 40 is larger than the current through reference voltage generating circuit in its normal state. Thus, a different reference voltage Vref from the desired voltage may be output. To solve such problem, start-up circuit 40 is electrically separated from reference voltage generator 10 by making start-up signal SU a low level. Thus, it is desirable to make the duration of the SU high level to be the most appropriate interval. In addition, it is desirable that the number of transistors is optimally determined in the start-up circuit. Even though the high level interval is not so long and the level of signal SU is not so high, if the number of transistors connected in series is smaller than the number of transistors which may cause an appropriate current to flow, then current through the transistors is larger, resulting in undesirable operation as explained above.

The reference voltage generating circuit according to the present invention has an advantage in reducing current consumption during the time of normal operation, because reference voltage generator 10 is activated by the high state only of start-up signal SU, which is initially generated by start-up circuit 40 when the external voltage Vcc is applied, and start-up circuit 40 is not operated during normal operation.

With prior circuits, the reference voltage may be unstable by R-C coupling between the power source Vcc and the reference voltage output port. The reference voltage produced by this invention, however, is very stable because start-up circuit 40 is separated from reference voltage generator 10 during normal operation.

Figure 7:
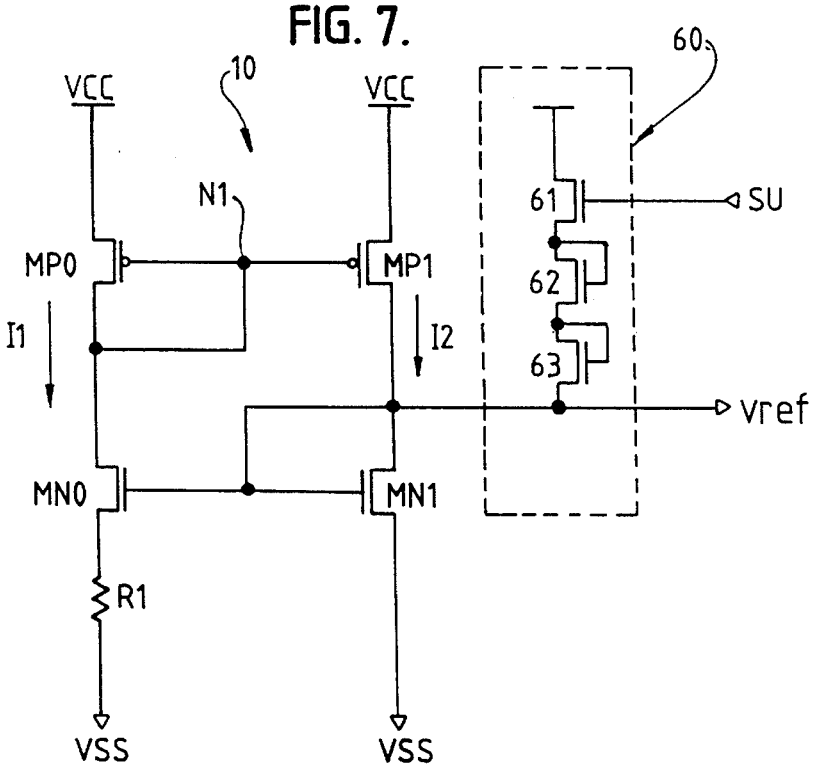
FIG. 7 is a circuit diagram illustrating a reference voltage generating circuit having a start-up circuit as another embodiment of this invention.

FIG. 7 illustrates a reference voltage generating circuit according to another embodiment of the present invention, comprising reference voltage generator 10 independently generating a reference voltage from an external power supply Vcc, and start-up circuit 60 connected between an output port of reference voltage generator 10 and power source Vcc. The same reference numbers are used in FIG. 7 for the same parts or components as in FIG. 4.

Start-up circuit 60 comprises a switching means turned on by signal SU increasing in accordance with the power Vcc voltage increasing initially, then to become a low level, and voltage reducing means connected between the switching means and the reference voltage output port. Start-up circuit 60 passes a Vcc voltage to the Vref output, which may be through a voltage reducing element, according to the switching means turning-on by signal SU having a high level. The start-up circuit is separated from the Vref output port after the SU signal becomes low, and thus circuit 10 outputs the appropriate reference voltage level, and is not affected by the start-up circuit 60.

Figure 8:
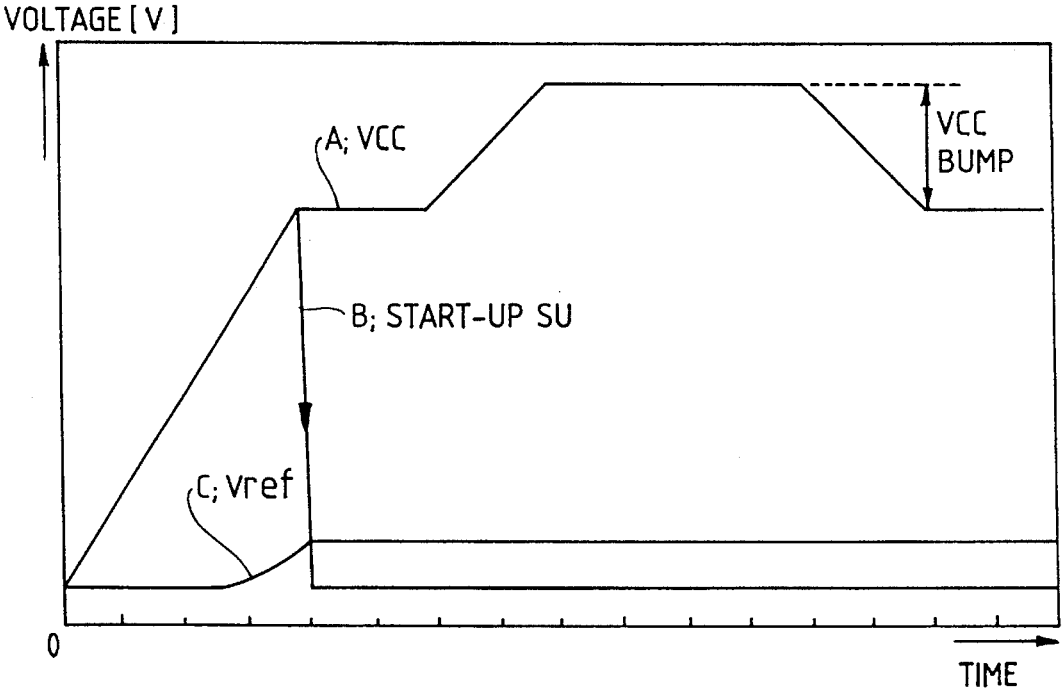
FIG. 8 illustrates the voltage level of various signals with respect to the circuit illustrated in FIG. 7.

FIG. 8 illustrates a voltage level of Vcc and the reference voltage.

In reference voltage generator 10, the potential of node N1 connected to the gates of PMOS transistors MP0 and MP1 increases as the power Vcc level increases, as illustrated by waveform A of FIG. 8. The level of signal SU from sensing circuit 50 increases according to the increase of the Vcc level as illustrated by waveform B of FIG. 8. Thus, reference voltage generator 10 outputs reference voltage Vref, as illustrated by waveform C of FIG. 8, by turning on transistors 61, 62 and 63 of start-up circuit 60.

If the reference voltage Vref of reference voltage generator 10 exceeds the threshold voltage of NMOS transistors MN0 and MN1, NMOS transistors MN0 and MN1 turn on and PMOS transistors MP0 and MP1 turn on, resulting in the flow of start-up current. Herein, resistor R1 between NMOS transistor MN0 and ground Vss serves to limit the amplitude of start-up current I1.

Start-up signal SU applied to start-up circuit 60 goes to a low level after a predetermined time to turn off NMOS transistor 61, i.e., a switching means. The bias current maintains a nearly constant level even though the power voltage Vcc increases, and thereby mirror current I2 maintains a nearly constant level as well. Therefore, reference voltage generator 10 produces a constant level of output voltage independent from the power Vcc voltage.

By separating the start-up circuit from the Vref output port by the switching means, the output Vref voltage may be constantly maintained, even though the power Vcc voltage may be bumped.

Although various preferred embodiments of the present invention have been disclosed for illustrative purposes, those skilled in the art will appreciate that various modifications, additions and/or substitutions are possible without departing from the scope and spirit of the present invention as disclosed in the claims.

What is claimed is:

1. A reference voltage generating circuit comprising:

a sensing circuit producing a signal pulse in response to application of a power source voltage, wherein the sensing circuit comprises a resistance means and a capacitor connected in series between the power source voltage and a reference potential and inverter means having an input connected to the series connection of the resistance means and capacitor, wherein the signal pulse is produced at an output of the inverter means;

a reference voltage generator producing a reference voltage on a reference voltage output terminal independent from the power source voltage; and a start-up circuit coupled to start the operation of the reference voltage generator when the signal pulse is produced by the sensing circuit, wherein the start-up circuit comprises a switching means for coupling and decoupling the power source voltage to the reference voltage output terminal, and a voltage reducing means connected between the switching means and the reference voltage output terminal for reducing the power source voltage coupled to the reference voltage output terminal.

2. The circuit of claim 1, wherein the voltage reducing means comprises a plurality of NMOS transistors connected in series.

3. The circuit of claim 2, wherein the plurality of NMOS transistors is determined so that the plurality of NMOS transistors are turned on when the signal pulse is at a high level.

4. The circuit of claim 1, wherein the reference voltage generator comprises:

first and second PMOS transistors with gates commonly connected to the drain of the first PMOS transistor and sources connected to the power source voltage;

first and second NMOS transistors with gates commonly connected to the drain of the second PMOS transistor; and a resistor between the reference potential and the source of the first NMOS transistor, with the drains of the second PMOS and second NMOS transistors commonly connected and outputting the reference voltage, with the drains of the first PMOS and first NMOS transistors commonly connected and to the start-up circuit, wherein current drawn by the start-up circuit causes the first and second PMOS transistors to turn on.

5. A reference voltage generating circuit comprising:

a sensing circuit producing a signal pulse in response to application of a power source voltage, wherein the sensing circuit comprises a resistance means and a capacitor connected in series between the power source voltage and a reference potential, and inverter means having an input connected to the series connection of the resistance means and capacitor, wherein the signal pulse is produced at an output of the inverter means;

a reference voltage generator producing a reference voltage on a reference voltage output terminal independent from the power source voltage, wherein the reference voltage generator comprises a pair of MOS transistors connected in a current mirror configuration; and a start-up circuit coupled to start the operation of the reference voltage generator when the signal pulse is produced by the sensing circuit, wherein the start-up circuit comprises a plurality of series-connected transistors connected in a diode configuration, wherein a first end of the series-connected transistors is connected to the reference potential, the start-up circuit further comprising a switching transistor connecting a second end of the series-connected transistors to the gates of the pair of MOS transistors connected in the current mirror configuration, wherein the gate of the switching transistor receives the signal pulse from the sensing circuit, and wherein the switching transistor draws current in response to the signal pulse and causes the pair of MOS transistors connected in the current mirror configuration to turn on.

6. The circuit of claim 5, wherein the plurality of transistors comprises a plurality of series-connected NMOS transistors.

7. The circuit of claim 6, wherein the number of NMOS transistors is determined so that the NMOS transistors are turned on by the signal pulse when the signal pulse is at a high level.

8. The reference circuit of claim 5, wherein the reference voltage generator comprises:

first and second PMOS transistors with gates commonly connected to a drain of the first PMOS transistor and sources connected to the power source voltage;

first and second NMOS transistors with gates commonly connected to the drain of the second NMOS transistor;

a resistor connected between the reference potential and the source of the first NMOS transistor, with the drains of the second PMOS and second NMOS transistors connected together and outputting the reference voltage; and the drains of the first PMOS and first NMOS transistors are connected together and to the start-up circuit, wherein current drawn by the start-up circuit causes the first and second PMOS transistors to turn on.

* * * * *